US012258744B2

(12) United States Patent
Kondo et al.

(10) Patent No.: US 12,258,744 B2
(45) Date of Patent: Mar. 25, 2025

(54) FLUSH WATER TANK DEVICE AND FLUSH TOILET APPARATUS PROVIDED WITH THE SAME

(71) Applicant: TOTO LTD., Kitakyushu (JP)

(72) Inventors: Yuta Kondo, Kitakyushu (JP); Koichiro Hiwa, Kitakyushu (JP); Yuki Shimokawa, Kitakyushu (JP); Kenji Hatama, Kitakyushu (JP); Haruki Matsuda, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 18/121,770

(22) Filed: Mar. 15, 2023

(65) Prior Publication Data

US 2023/0313512 A1 Oct. 5, 2023

(30) Foreign Application Priority Data

Mar. 31, 2022 (JP) ..... 2022-059285

(51) Int. Cl.
*E03D 1/14* (2006.01)
*E03D 1/34* (2006.01)

(52) U.S. Cl.
CPC ..... *E03D 1/142* (2013.01); *E03D 1/34* (2013.01); *E03D 2201/40* (2013.01)

(58) Field of Classification Search
CPC ... E03D 1/01–0125; E03D 1/14; E03D 1/141; E03D 1/142–145; E03D 1/16–165; E03D 1/24–286; E03D 1/30–36; E03D 2201/00–20
See application file for complete search history.

(56) References Cited

U.S. PATENT DOCUMENTS 685,406 A * 10/1901 Marcellus ..... E03D 1/308 4/382
2,058,449 A * 10/1936 Heath ..... E03D 1/304 4/353

(Continued)

FOREIGN PATENT DOCUMENTS

GB 822385 * 10/1959 ..... E03D 1/012
JP H0874307 A 3/1996

(Continued)

OTHER PUBLICATIONS

Office Action for JP Application No. 2022-059285, issued Aug. 9, 2023.

*Primary Examiner* — David P Angwin
*Assistant Examiner* — Nicholas A Ros
(74) *Attorney, Agent, or Firm* — IceMiller LLP

(57) ABSTRACT

The present invention is a flush water tank device including a flush water tank main body, a water supply valve, and a discharge valve, in which during a flush of the flush toilet, the discharge valve is opened until a water level in the flush water tank main body is lowered from a predetermined full water level to a predetermined dead water level, a lowering speed of the water level in the flush water tank main body changes at a predetermined inflection water level between the full water level and the dead water level, and the lowering speed of the water level between the inflection water level and the dead water level is faster than the lowering speed of the water level between the full water level and the inflection water level.

7 Claims, 4 Drawing Sheets

(56) References Cited

U.S. PATENT DOCUMENTS

| | | | | | |
|---|---|---|---|---|---|
| 2,059,749 | A * | 11/1936 | Rosewood | E03D 1/30 | 4/402 |
| 2,534,524 | A * | 6/1964 | Molloy | E03D 5/024 | 4/367 |
| 3,135,968 | A * | 6/1964 | Parrish | E03D 1/01 | 4/416 |
| 5,363,513 | A * | 11/1994 | Blankenburg | E03D 3/10 | 4/361 |
| 6,237,164 | B1 * | 5/2001 | LaFontaine | E03D 1/01 | 4/398 |
| 2008/0163414 | A1 * | 7/2008 | Andronyk | E03D 1/14 | 4/415 |

FOREIGN PATENT DOCUMENTS

| | | | | |
|---|---|---|---|---|
| JP | 2013100668 | A | 5/2013 | |
| JP | 2019-060181 | A | 4/2019 | |
| JP | 2019060181 | * | 4/2019 | E03D 1/26 |

* cited by examiner

FLUSH WATER TANK DEVICE AND FLUSH TOILET APPARATUS PROVIDED WITH THE SAME

BACKGROUND OF THE INVENTION

Field of the Invention

The present invention relates to a flush water tank device, and particularly to a flush water tank device that stores flush water for flushing a flush toilet, and a flush toilet apparatus provided with the same.

Description of the Related Art

A flush water tank device for flushing a flush toilet is disclosed in Japanese Patent Laid-Open No. 2019-60181. The flush water tank device includes a flush water tank and a discharge valve device provided in a bottom portion of the flush water tank. The discharge valve device includes a discharge valve that opens and closes a discharge port, and the discharge valve is opened during a toilet flush until a water level in the flush water tank is lowered from a predetermined full water level to a predetermined water level. The discharge valve device causes the discharge valve to be opened to drain the flush water in the flush water tank to the flush toilet, whereby the flush toilet is flushed.

As in the flush water tank device disclosed in Japanese Patent Laid-Open No. 2019-60181, a low-silhouette type flush water tank is often designed to have a large bottom area of the water flush tank to store a sufficient amount of flush water. Therefore, the water level in the flush water tank is lowered very slowly during the toilet flush in which the flush water in the flush water tank is drained. On the other hand, the discharge valve configured to open and close the discharge port of the flush water tank falls down with lowering of the water level in the flush water tank, and finally causes the discharge port to be closed.

However, when a lowering speed of the water level in the flush water tank is slow, a problem occurs in that operation of the discharge valve falling down following the lowering of the water level is not stable. When the operation of the discharge valve is not stable, a flush state of the flush toilet varies for each one flush, which may cause reduction in flushing performance. When a slightly open state of the discharge port is continued immediately before the discharge port is closed by the discharge valve, a small flow rate of flush water is continuously drained from the flush water tank without contributing to the toilet flush, whereby waste water is generated.

Accordingly, an object of the present invention is to provide a flush water tank device capable of reducing variation in flushing performance by stabilizing the operation of a discharge valve, and a flush toilet apparatus provided with the same.

SUMMARY OF THE INVENTION

To solve the above problems, the present invention provides a flush water tank device that stores flush water for flushing a flush toilet, the flush water tank device including a flush water tank main body that includes a discharge port and is configured to store the flush water, a water supply valve that causes the flush water supplied from a water supply source to flow into the flush water tank main body, and a discharge valve that is provided in the flush water tank main body and is configured to open and close the discharge port to switch between discharging and stopping of the flush water stored in the flush water tank main body to the flush toilet, in which during a flush of the flush toilet, the discharge valve is opened until a water level in the flush water tank main body is lowered from a predetermined full water level to a predetermined dead water level, a lowering speed of the water level in the flush water tank main body changes at a predetermined inflection water level between the full water level and the dead water level, and the lowering speed of the water level between the inflection water level and the dead water level is faster than the lowering speed of the water level between the full water level and the inflection water level.

In the present invention configured as described above, the flush water supplied from the water supply source flows into the flush water tank main body by the water supply valve, and the flush water stored in the flush water tank main body is discharged to the flush toilet by opening the discharge valve. The water level in the flush water tank main body is lowered in which the lowering speed of the water tank between the inflection water level and the dead water level is set to be faster than the lowering speed of the water level between the full water level and the inflection water level.

According to the present invention configured as described above, since the lowering speed of the water level is set to be faster during a time period between the inflection water level and the dead water level, the discharge valve approaching the discharge port closes the discharge port rapidly, whereby the operation of the discharge valve can be stabilized and the variation in flushing performance can be reduced. Since the lowering speed of the water level is set to be slower during a time period between the full water level and the inflection water level, a sufficient amount of flush water can be discharged to the flush toilet during this time period, whereby the necessary amount of the flush water can be secured.

In the present invention, preferably, during a flush of the flush toilet, a time period required for lowering the water level in the flush water tank main body from the full water level to the inflection water level is longer than a time period required for lowering the water level in the flush water tank main body from the inflection water level to the dead water level.

According to the present invention configured as described above, since the time period required for lowering the water level in the flush water tank main body from the full water level to the inflection water level is long, the sufficient amount of the flush water can be discharged to the flush toilet during this time period, whereby the sufficient flushing performance can be secured.

In the present invention, preferably, during a flush of the flush toilet, an amount of the flush water discharged from the discharge port while the water level in the flush water tank main body is lowered from the full water level to the inflection water level is larger than the amount of the flush water discharged from the discharge port while the water level in the flush water tank main body is lowered from the inflection water level to the dead water level.

According to the present invention configured as described above, since the amount of the flush water discharged from the discharge port while the water level in the flush water tank main body is lowered from the full water level to the inflection water level is large, the sufficient amount of the flush water can be discharged to the flush toilet while increasing the lowering speed of the water level near the dead water level, whereby the sufficient flushing performance can be secured.

In the present invention, preferably, the flush water tank main body is formed so that a horizontal cross-sectional area on a side upper than the inflection water level is larger than a horizontal cross-sectional area on a side lower than the inflection water level.

According to the present invention configured as described above, since the horizontal cross-sectional area on the side upper than the inflection water level is larger than the horizontal cross-sectional area on the side lower than the inflection water level, the lower speed of the water level can be increased on the side lower than the inflection water level when the flow rate of the flush water discharged from the discharge port is constant, whereby the lower speed of the water level can be changed with a simple configuration.

In the present invention, preferably, the discharge valve is placed on one side with respect to a centerline in a horizontal direction of the flush water tank main body.

According to the present invention configured as described above, since the discharge valve is placed on one side with respect to the centerline in the horizontal direction of the flush water tank main body, the cutout portion can be created easily on the other side of the flush water tank main body on which the discharge valve is not placed, which results in effective utilization of a space.

In the present invention, preferably, the flush water tank main body is configured so that a volume on one side with respect to the centerline in the horizontal direction of the flush water tank main body is larger than a volume on the other side, and the discharge valve is placed on the side having a larger volume with respect to the centerline in the horizontal direction of the flush water tank main body.

According to the present invention configured as described above, since the discharge valve is placed on the side having a larger volume with respect to the centerline in the horizontal direction of the flush water tank main body, the discharge valve and a mechanism configured to drive the discharge valve can be easily accommodated in the flush water tank main body.

In the present invention, preferably, at least a part of a bottom surface of the flush water tank main body is sloped so that a portion of the bottom surface in which the discharge valve is provided is set low.

According to the present invention configured as described above, since the bottom surface of the flush water tank main body is sloped so that the portion of the bottom surface in which the discharge valve is provided is set low, the flush water in the flush water tank main body is collected in the portion in which the discharge valve is provided, which makes it possible to effectively utilize the flush water in the flush water tank main body.

In the present invention, preferably, the water supply valve is configured to cause the flush water supplied from the water supply source to flow into the flush water tank main body during a time period from when the discharge valve is opened until the water level in the flush water tank main body is lowered from the full water level to the inflection water level, and to stop the flush water flowing in from the water supply source or reduce a flow rate of the flush water flowing in the flush water tank main body when the water level in the flush water tank main body becomes lower than the inflection water level.

In the present invention configured as described above, the water supply valve causes the flush water to flow into the flush water tank main body during the time period from when the discharge valve is opened until the water level in the flush water tank main body is lowered from the full water level to the inflection water level. When the water level is lower than the inflection water level, the water supply valve stops the flush water flowing into the flush water tank main body or reduces the flow rate of the flush water.

According to the present invention configured as described above, the water is discharged while being supplied to the flush water tank main body while the water level is lowered from the full water level to the inflection water level, which enables the lowering speed of the water level to be reduced. Therefore, even when a normal flush water tank main body in which the horizontal cross-sectional area is substantially constant is used, the lowering speed of the water level between the inflection water level and the dead water level can be faster than the lowering speed of the water level between the full water level and the inflection water level.

The present invention is a flush toilet apparatus including a flush toilet that includes a bowl, and a rim spout port and a jet spout port configured to discharge flush water for washing the bowl, and the flush water tank device of the present invention configured to store the flush water to be discharged from the jet spout port.

According to a flush water tank device of the present invention and a flush toilet apparatus provided with the same, the operation of the discharge valve can be stabilized and variation in flushing performance can be reduced.

DETAILED DESCRIPTION OF THE PREFERRED EMBODIMENTS

Figure 1:
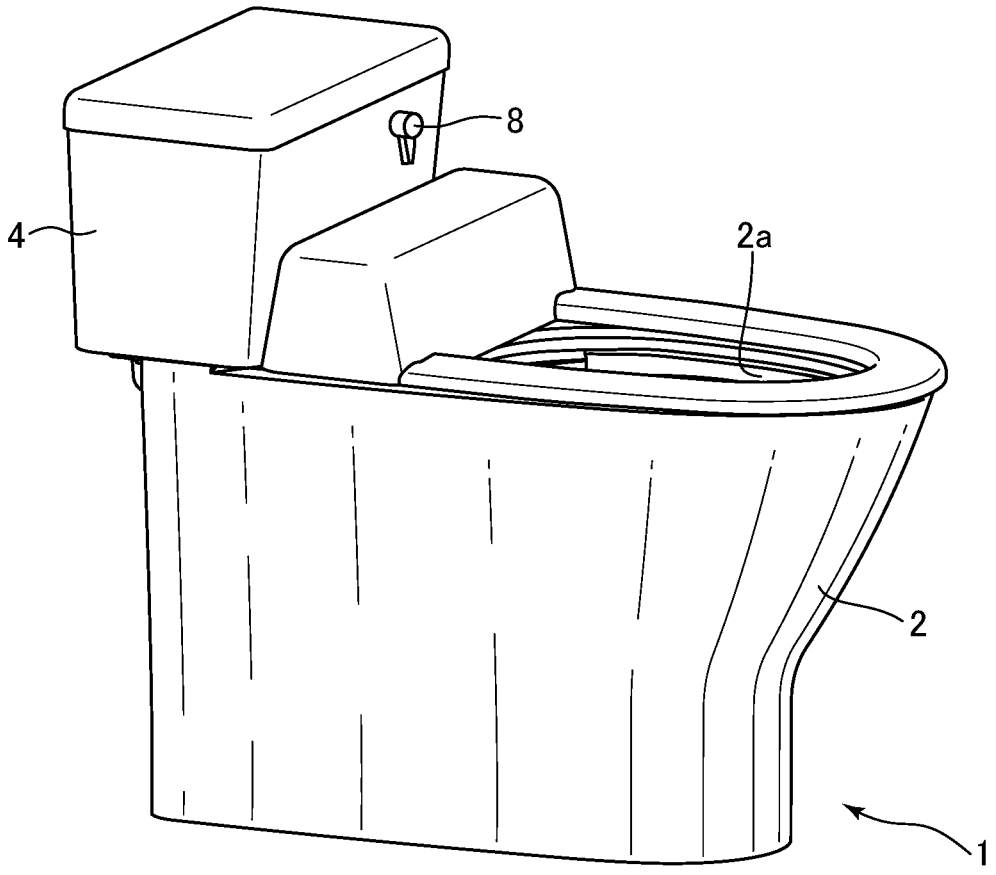
FIG. 1 is a perspective view illustrating an entire flush toilet apparatus according to a first embodiment of the present invention.
Figure 2:
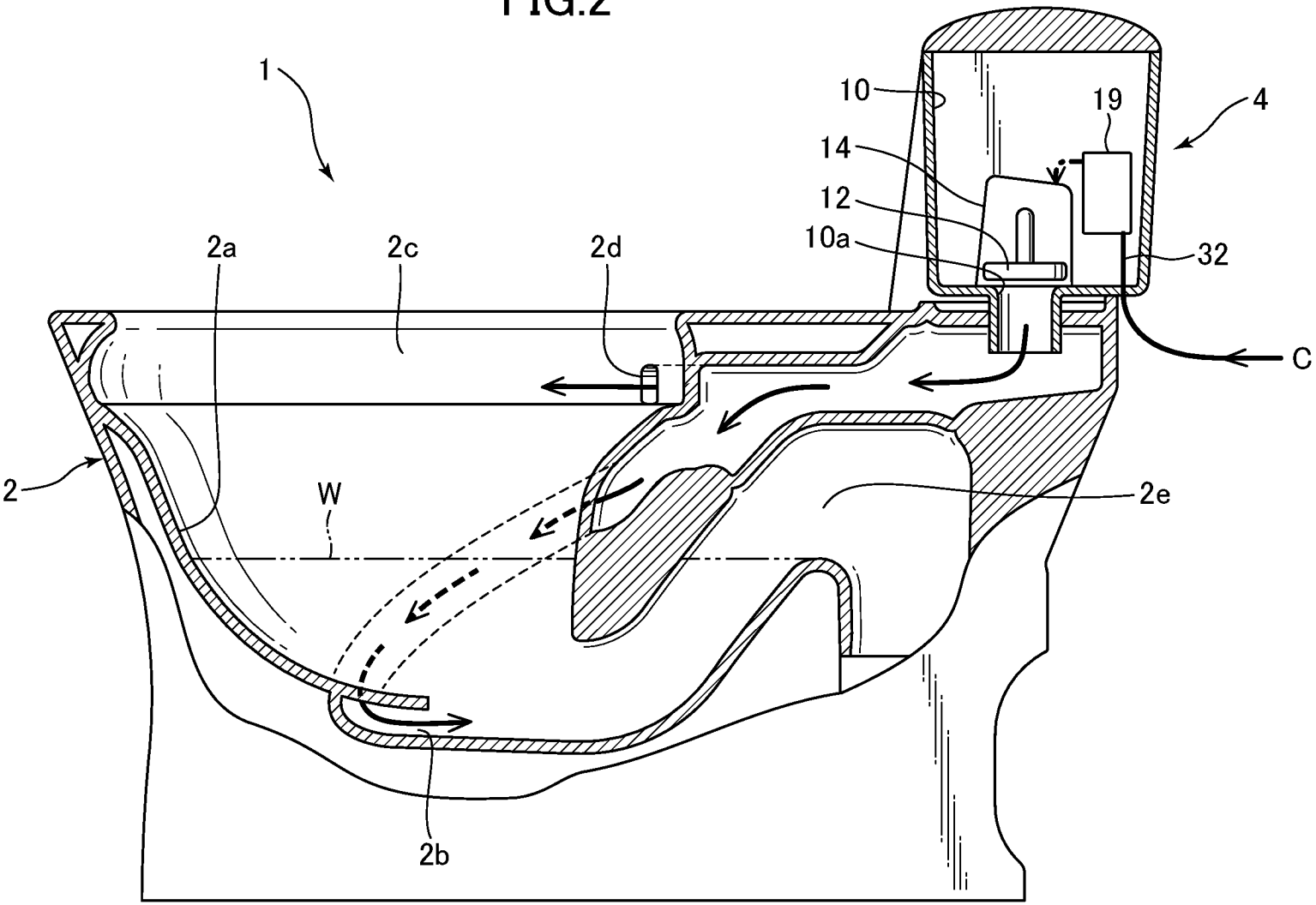
FIG. 2 is a full cross-sectional view of the flush toilet apparatus according to the first embodiment of the present invention.
Figure 3:
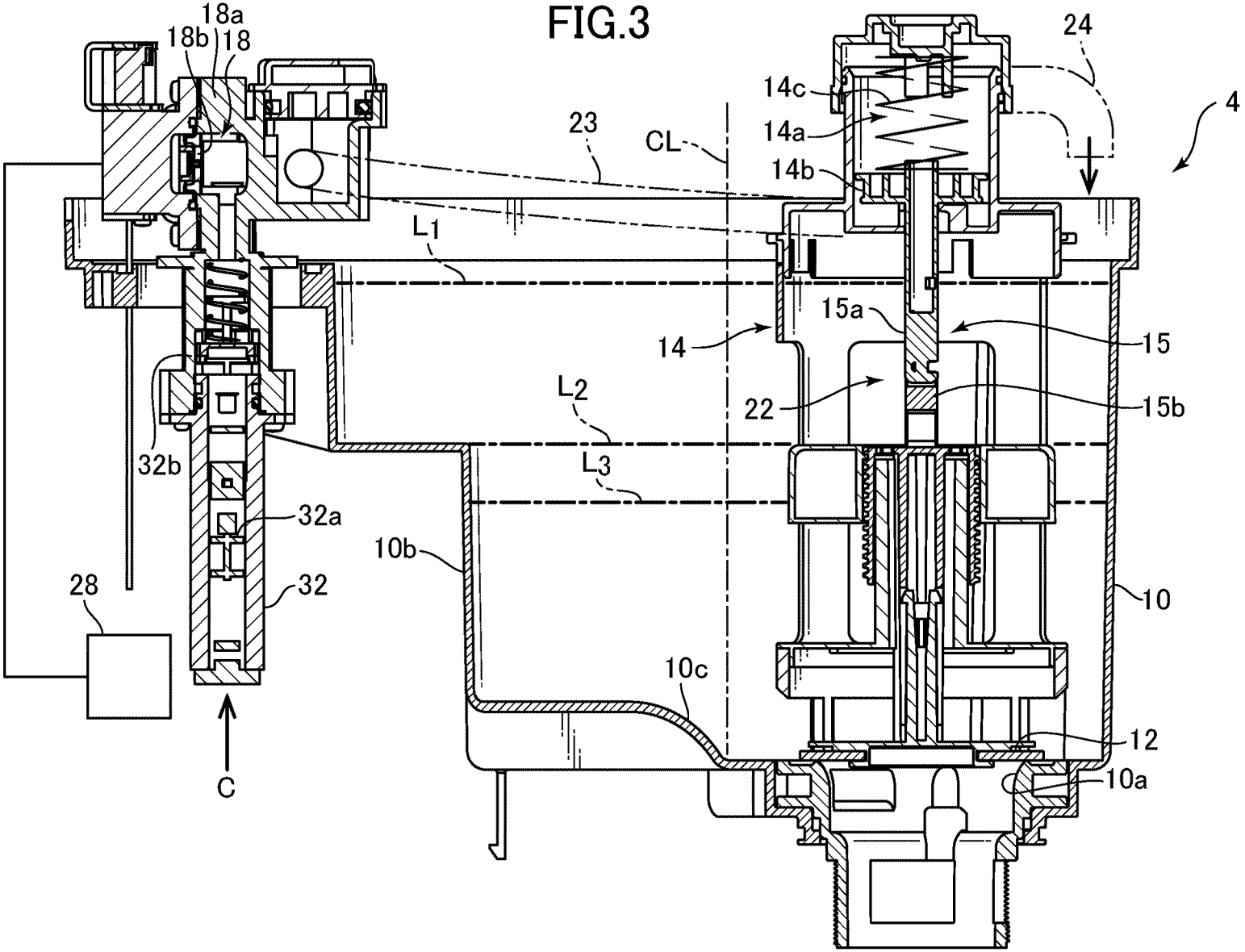
FIG. 3 is a cross-sectional view illustrating a configuration of a flush water tank device of the first embodiment of the present invention.

Next, a flush water tank device according to embodiments of the present invention and a flush toilet apparatus provided with the same will be described with reference to the accompanying drawings. FIG. 1 is a perspective view illustrating an entire flush toilet apparatus according to a first embodiment of the present invention. FIG. 2 is a full cross-sectional view of the flush toilet apparatus according to the first embodiment of the present invention. FIG. 3 is a cross-sectional view illustrating a configuration of a flush water tank device of the first embodiment of the present invention.

As illustrated in FIGS. 1 and 2, a flush toilet apparatus 1 according to the first embodiment of the present invention includes a flush toilet main body 2, which is a flush toilet, and a flush water tank device 4 mounted at a rear portion of the flush toilet main body 2. The flush toilet apparatus 1 of the present embodiment is configured to wash a bowl 2*a* of the flush toilet main body 2 in response to operation of a lever handle 8 provided on the flush water tank device 4 after use of the flush toilet apparatus 1. The flush water tank device 4 provided in the present embodiment is configured to drain to the flush toilet main body 2, flush water stored in the flush water tank device 4 in response to the operation of the lever handle 8 and wash the bowl 2*a*.

As a modified example, the present invention can be also constituted so that washing of the bowl 2*a* is brought about by operation of a remote control device (not illustrated) attached to a wall surface. Alternatively, the present invention can be also constituted so that the washing of the bowl 2*a* is brought after an elapse of a predetermined time period after a human sensor (not illustrated) provided in a toilet seat detects that a user has stood from the toilet seat. In this case, the human sensor (not illustrated) may be provided in the toilet seat or at any position where user's motions of sitting on, standing from, approach to and departure from the toilet seat, and holding his/her hand over the sensor can be detected, and, therefore, may be provided in the flush toilet main body 2 or the flush water tank device 4, for example. The human sensor (not illustrated) may be any sensor capable of detecting the user's motions of sitting on, standing from, approach to and departure from the toilet seat, and holding his/her hand over the sensor, and therefore, for example, an infrared sensor or a microwave sensor may be used as the human sensor.

Next, as illustrated in FIG. 2, the flush water tank device 4 includes a reservoir tank 10, which is a flush water tank main body configured to store flush water to be supplied to the flush toilet main body 2, a discharge valve 12 for opening and closing a discharge port 10*a* provided in the reservoir tank 10, and a discharge valve hydraulic drive part 14, which is a hydraulic drive mechanism configured to drive the discharge valve 12. Furthermore, the flush water tank device 4 includes a water supply valve 19 which causes flush water to flow into the reservoir tank 10, the flush water being supplied from a waterworks C, which is a water supply source.

Here, during a toilet flush, the flush water stored in the reservoir tank 10 is drained by opening the discharge valve 12, and then is discharged from a jet spout port 2*b* provided in a lower portion of the bowl 2*a* of the flush toilet main body 2 and a rim spout port 2*d* provided in a rim 2*c* of the bowl 2*a*. Furthermore, a water discharge trap pipe 2*e* communicates with the lower portion of the bowl 2*a*, and an inlet of the water discharge trap pipe 2*e* is directed to face the jet spout port 2*b*. After the toilet flush, the water supply valve 19 causes flush water supplied from the waterworks C to flow into and be stored in the reservoir tank 10 in order to use the flush water for a next toilet flush.

Next, a configuration of the flush water tank device 4 according to the first embodiment of the present invention will be described with reference to FIG. 3. FIG. 3 is a cross-sectional view illustrating a configuration of the flush water tank device of the first embodiment of the present invention.

As illustrated in FIG. 3, the flush water tank device 4 included in the flush toilet apparatus of the present embodiment includes the reservoir tank 10, the discharge valve 12 configured to open and close the discharge port 10*a* of the reservoir tank 10, and the discharge valve hydraulic drive part 14, which is the hydraulic drive mechanism configured to drive the discharge valve 12. Furthermore, the flush water tank device 4 includes a water spout control valve 18 configured to supply the flush water to the discharge valve hydraulic drive part 14, and a controller 28 configured to control the water spout control valve 18 and the water supply valve 19 (FIG. 2).

The reservoir tank 10 is a tank configured to store the flush water to be supplied to the jet spout port 2*b* and the rim spout port 2*d* (FIG. 2) of the flush toilet main body 2, and the discharge port 10*a* for discharging the stored flush water into the flush toilet main body 2 is formed in a bottom portion of the reservoir tank 10. As illustrated in FIG. 3, the discharge port 10*a* is provided in a bottom surface of an end portion on one side in front view, and the discharge valve 12 for opening and closing the discharge port 10*a* and the discharge valve hydraulic drive part 14 for driving the discharge valve 12 are placed above the discharge port 10*a*. The water spout control valve 18 configured to supply the flush water to the discharge valve hydraulic drive part 14 and the water supply valve 19 (not illustrated in FIG. 3) configured to supply the water into the reservoir tank 10 are placed above an end portion on a side opposite to the discharge valve hydraulic drive part 14. Note that these water spout control valve 18 and water supply valve 19 are placed above a full water level $L_1$ of the reservoir tank 10.

The reservoir tank 10 is formed into a substantially rectangular parallelepiped shape as a whole and is provided with a cutout portion 10*b* in the lower portion on one side in front view. Therefore, the reservoir tank 10 has a larger horizontal cross-sectional area above the cutout portion 10*b* and has a smaller horizontal cross-sectional area below the cutout portion 10*b*. A sloping surface 10*c* is provided in a part of the bottom surface of the reservoir tank 10, and the discharge port 10*a* is provided in a lowered portion of the bottom surface of the reservoir tank 10.

Furthermore, the discharge port 10*a*, the discharge valve 12, and the discharge valve hydraulic drive part 14 are provided on one side (a right side in FIG. 3) of the reservoir tank 10 with respect to a centerline CL in the horizontal direction in front view, and the cutout portion 10*b*, the water spout control valve 18, and the water supply valve 19 are provided on the other side (a left side in FIG. 3) of the reservoir tank 10. As a result, the reservoir tank 10 has larger volume on the side (the right side in FIG. 3) on which the discharge port 10*a*, the discharge valve 12 and the discharge valve hydraulic drive part 14 are provided, with respect to the centerline CL in the horizontal direction and has smaller volume on the side (the left side in FIG. 3) on which the water spout control valve 18 and the water supply valve 19 are placed.

The discharge valve 12 is a valve body placed to open and close the discharge port 10*a* and is opened when the discharge valve 12 is pulled up upward, whereby the flush water in the reservoir tank 10 is drained into the flush toilet main body 2 and is discharged from the jet spout port 2*b* and the rim spout port 2*d* which are provided in the bowl 2*a*.

On the other hand, the flush water supplied to a water supply pipe 32 from the waterworks C is introduced into the reservoir tank 10 via a stop cock 32*a* and a fixed flow valve 32*b*, and splits into the water spout control valve 18 and the water supply valve 19 (FIG. 2).

The stop cock 32*a* is provided to stop the water supply to the flush water tank device 4 at the time of maintenance or the like and is normally used in an open state. The fixed flow valve 32*b* is provided to cause the water supplied from the waterworks C to flow thereinto at a predetermined flow rate and is configured to supply the water to the flush water tank device 4 at a constant flow rate regardless of a placement environment of the flush toilet apparatus.

The water supply valve 19 (FIG. 2) is configured to cause the water supplied from the water supply pipe 32 to flow into the reservoir tank 10 so that the water is stored in the reservoir tank 10. In the present embodiment, the water supply valve 19 is opened after the termination of the toilet flush so that the flush water is stored at a predetermined full water level in the reservoir tank 10. Note that, in a standby state of the flush water tank device 4, the water level in the reservoir tank 10 is the full water level $L_1$.

The water supply valve 19 includes a water supply valve main body, a main valve body placed in the water supply valve main body, and an electromagnetic valve pilot valve (these are not illustrated). Furthermore, the water supply valve 19 is connected with an electromagnetic valve for water supply control (not illustrated), and the electromagnetic valve for water supply control moves the electromagnetic valve pilot valve on the basis of a signal transmitted from the controller 28. That is, the electromagnetic valve pilot valve is configured to open and close a pilot valve port (not illustrated) provided in the water supply valve main body, and when the pilot valve port is opened, the pressure inside a pressure chamber provided in the water supply valve main body decreases, and the main valve body of the water supply valve 19 is opened. In addition, when the pilot valve port (not illustrated) is closed, the pressure inside the pressure chamber increases, and the main valve body is closed. Accordingly, the main valve body of the water supply valve 19 is opened and closed in response to the operation of the electromagnetic valve for water supply control to thereby control supply and stop of the water into the reservoir tank 10.

Next, the water spout control valve 18 is configured to cause the water supplied from the water supply pipe 32 to flow out to the discharge valve hydraulic drive part 14. The water spout control valve 18 includes a control valve main body 18*a*, a main valve body 18*b* placed in the control valve main body 18*a*, and an electromagnetic valve pilot valve (not illustrated). Furthermore, the water spout control valve 18 is connected with an electromagnetic valve for water spout control (not illustrated).

The electromagnetic valve for water spout control (not illustrated) is configured to move the electromagnetic valve pilot valve (not illustrated) incorporated in the water spout control valve 18 to open and close a pilot valve port (not illustrated) on the basis of a signal transmitted from the controller 28. When the pilot valve port (not illustrated) is opened, the pressure inside a pressure chamber provided in the control valve main body 18*a* decreases, and the main valve body 18*b* of the water spout control valve 18 is opened. In addition, when the pilot valve port (not illustrated) is closed, the pressure inside the pressure chamber increases, and the main valve body 18*b* is closed. Accordingly, the main valve body 18*b* of the water spout control valve 18 is opened and closed in response to the operation of the electromagnetic valve for water spout control to thereby control supply and stop of the water to the discharge valve hydraulic drive part 14. Note that in the present embodiment, as the electromagnetic valve for water spout control, there is used a bistable latching solenoid that moves the electromagnetic valve pilot valve when the energization is performed once and maintains this state even when the energization is stopped. This type of electromagnetic valve can return the electromagnetic valve pilot valve to an original position when the energization is performed again in the opposite direction.

Specifically, the controller 28 receives a signal from the lever handle 8 and transmits an electric signal to the electromagnetic valve for water spout control (not illustrated), to actuate the electromagnetic valve for water spout control, which causes the water spout control valve 18 to be opened. The water spout control valve 18 controls supply and stop of the supplied flush water to the discharge valve hydraulic drive part 14 on the basis of an instruction signal from the controller 28. In the present embodiment, the total amount of the flush water that has flowed out of the water spout control valve 18 is supplied to the discharge valve hydraulic drive part 14 through an inflow pipe 23.

Next, the discharge valve hydraulic drive part 14 is configured to drive the discharge valve 12 using the water supply pressure of the flush water supplied from the waterworks C. Specifically, the discharge valve hydraulic drive part 14 includes a cylinder 14*a* into which the water supplied from the water spout control valve 18 flows, a piston 14*b* slidably placed in the cylinder 14*a*, and a rod 15 that protrudes from a lower end of the cylinder 14*a* to drive the discharge valve 12. Furthermore, a spring 14*c* is placed inside the cylinder 14*a*, and urges the piston 14*b* downward.

The cylinder 14*a* is a cylindrical member that is placed so that an axis thereof is oriented in the vertical direction, and slidably accommodates the piston 14*b* therein. The inflow pipe 23 is connected to a lower end portion of the cylinder 14*a* so that the water that has flowed out of the water spout control valve 18 flows into the cylinder 14*a*. Therefore, the piston 14*b* in the cylinder 14*a* is pushed up against the urging force of the spring 14*c* by the water that has flowed into the cylinder 14*a*.

On the other hand, an outflow hole is provided in an upper end portion of the cylinder 14*a*, and an outflow pipe 24 communicates with the interior of the cylinder 14*a* via the outflow hole. Accordingly, when the water flows into the cylinder 14*a* from the inflow pipe 23 connected to the lower portion of the cylinder 14*a*, the piston 14*b* is pushed up upward from the lower portion of the cylinder 14*a*. Then, when the piston 14*b* is pushed up to above the outflow hole, the water that has flowed into the cylinder 14*a* flows out of the outflow hole through the outflow pipe 24. That is, the inflow pipe 23 and the outflow pipe 24 communicate with each other via the interior of the cylinder 14*a* when the piston 14*b* is moved upward. The flush water that has flowed out of the outflow pipe 24 flows into the reservoir tank 10.

The rod 15 is a rod-shaped member connected to a lower surface of the piston 14*b* and extends to protrude downward from the inside of the cylinder 14*a* through a through hole formed in a bottom surface of the cylinder 14*a*. The discharge valve 12 is connected to a lower end of the rod 15, and the rod 15 connects the piston 14*b* and the discharge valve 12. Therefore, when the water flows into the cylinder 14*a* and the piston 14*b* is pushed up, the rod 15 connected to the piston 14*b* lifts the discharge valve 12 upward, whereby the discharge valve 12 is opened.

Furthermore, a clutch mechanism 22 is provided in the middle of the rod 15. The clutch mechanism 22 is configured to separate the rod 15 into an upper rod 15*a* and a lower rod 15*b* when the discharge valve 12 is lifted up by a predetermined distance together with the rod 15. In a state in which the clutch mechanism 22 is disengaged, the lower rod 15*b* and the discharge valve 12 attached thereto cease to move in association with the movement of the upper portion including the piston 14*b* and the upper rod 15*a*. The lower rod 15*b* and the discharge valve 12 separated from the upper rod fall down toward the discharge port 10*a* with lowering of the water level in the reservoir tank 10. When the lower rod 15*b* and the discharge valve 12 fall down and are seated on the discharge port 10*a*, the flush water stops being discharged from the discharge port 10*a*.

The controller 28 incorporates a circuit board therein and is configured to control the electromagnetic valve for water spout control (not illustrated) connected to the water spout control valve 18 and the electromagnetic valve for water supply control (not illustrated) connected to the water supply valve 19, and the like in response to the operation of the lever handle 8. A microprocessor, a memory, an interface circuit, and the like (these are not illustrated) are provided on the circuit board, and these are operated by software for controlling the toilet flush.

Figure 4:
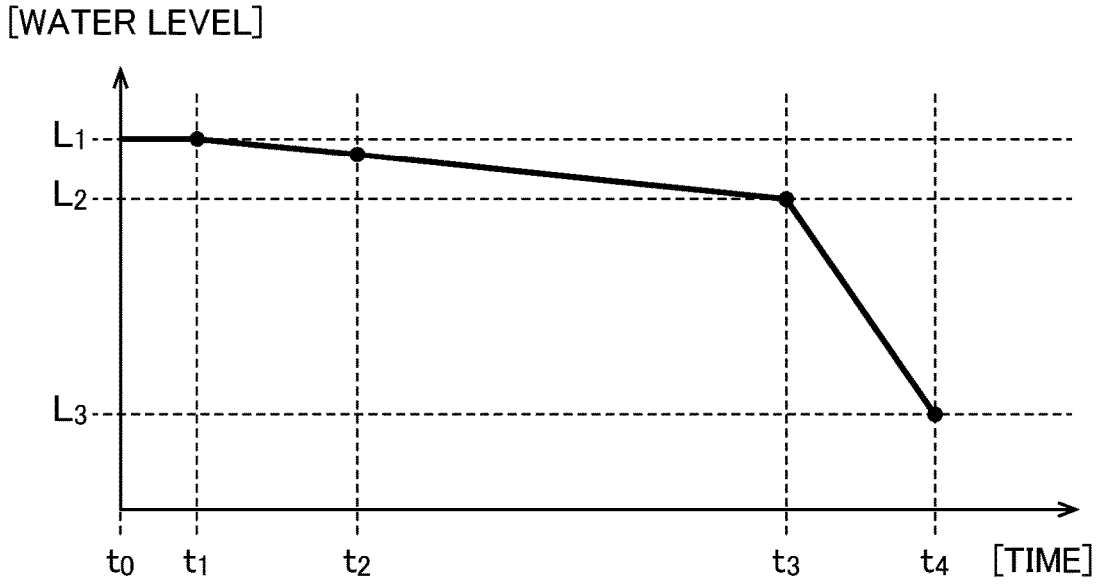
FIG. 4 is a graph showing a temporal change in water level in a reservoir tank during a toilet flush in the flush water tank device of the first embodiment of the present invention.

Next, the flush toilet apparatus 1 according to the first embodiment of the present invention and operation of the flush water tank device 4 will be described with reference to FIG. 4. FIG. 4 is a graph showing a temporal change in water level in the reservoir tank 10 during a toilet flush in the flush water tank device 4 of the present embodiment.

First, in a standby state of a toilet flush at time to in FIG. 4, a water level in the reservoir tank 10 is the full water level $L_1$, and no energization is performed to the electromagnetic valve for water spout control (not illustrated) connected to the water spout control valve 18 and the electromagnetic valve for water supply control (not illustrated) connected to the water supply valve 19. In this state, the water spout control valve 18 and the water supply valve 19 are closed.

Next, when a user operates the lever handle 8 at time $t_1$ in FIG. 4 to execute the toilet flush, a signal instructing the toilet flush is transmitted to the controller 28 (FIG. 3). When receiving the instruction signal for the toilet flush, the controller 28 performs the energization to the electromagnetic valve for water spout control of the water spout control valve 18 to open the water spout control valve 18. Note that in the present embodiment, since a bistable latching solenoid is used as the electromagnetic valve for water spout control, once the pilot valve port (not illustrated) of the water spout control valve 18 is opened, the valve open state is maintained even when the energization is stopped.

When the water spout control valve 18 is opened, tap water (flush water) supplied from the water supply pipe 32 is supplied to the discharge valve hydraulic drive part 14 through the water spout control valve 18 and the inflow pipe 23. The flush water supplied to the discharge valve hydraulic drive part 14 flows into the cylinder 14*a*, pushes up the piston 14*b*, and flows out of the outflow pipe 24. Hereby, the rod 15 connected to the piston 14*b* and the discharge valve 12 are also lifted up, whereby the discharge port 10*a* is opened. That is, when the flush operation is performed at time $t_1$ in FIG. 4, the discharge valve 12 starts to be opened, and the discharge valve 12 is fully opened at time $t_2$.

Hereby, the flush water stored in the reservoir tank 10 flows out through the discharge port 10*a*. The flush water that has flowed out of the reservoir tank 10 is discharged as jet water discharge from the jet spout port 2*b* (FIG. 2) provided in the lower portion of the bowl 2*a* and as rim water discharge from the rim spout port 2*d* provided in the rim 2*c* of the bowl 2*a*, whereby the bowl 2*a* is washed.

On the other hand, when the piston 14*b* is pushed up in the discharge valve hydraulic drive part 14 and accordingly the rod 15 and the discharge valve 12 are lifted up to a predetermined position, the clutch mechanism 22 separates the lower rod 15*b* and the discharge valve 12 from the upper rod 15*a*. The lower rod 15*b* and the discharge valve 12 separated from the upper rod fall down toward the discharge port 10*a* by gravity with lowering of the water level in the reservoir tank 10 while receiving buoyancy from the flush water in the reservoir tank 10.

After the lower rod 15*b* and the discharge valve 12 are separated from the upper rod, the controller 28 (FIG. 3) performs the energization to the electromagnetic valve for water spout control of the water spout control valve 18 to close the water spout control valve 18. When the water spout control valve 18 is closed and the water stops being supplied to the discharge valve hydraulic drive part 14, the piston 14*b* is pushed down by the spring 14*c*. However, since the lower rod 15*b* and the discharge valve 12 are separated from the upper rod, the lower rod 15*b* and the discharge valve 12 continues to fall down regardless of the movement of the piston 14*b* and the upper rod 15*a*.

On the other hand, as shown in FIG. 4, when the discharge valve 12 is opened at time $t_1$, the flush water stored in the reservoir tank 10 is discharged, whereby the water level of the flush water in the reservoir tank 10 starts to be lowered from the full water level $L_1$ in the standby state. Here, in a state in which the water level in the reservoir tank 10 is placed above the cutout portion 10*b*, the horizontal cross-sectional area of the reservoir tank 10 is large, and therefore, the water level in the reservoir tank 10 is lowered slowly. Therefore, the discharge valve 12 also falls down slowly.

When the water level in the reservoir tank 10 is further lowered and the water level in the reservoir tank 10 is lowered up to the height of the cutout portion 10*b*, the horizontal cross-sectional area of the reservoir tank 10 is reduced at the height of the cutout portion 10*b*, and therefore the lowering speed of the water level in the reservoir tank 10 increases. That is, when the water level in the reservoir tank 10 is between the full water level $L_1$ and an inflection water level $L_2$ which is the height of the cutout portion 10*b*, the lowering speed of the water level is slow, and when the water level in the reservoir tank 10 is equal to or lower than the inflection water level $L_2$, the lowering speed of the water level increases.

That is, after the discharge valve 12 is opened at time $t_1$ in FIG. 4, the lowering speed of the water level in the reservoir tank 10 is slow (the slope of the graph in FIG. 4 is gentle) while the water level is higher than the inflection water level $L_2$, and when the water level in the reservoir tank 10 is lowered up to the inflection water level $L_2$ at time $t_3$, the lowering speed of the water level increases (the slope of the graph in FIG. 4 becomes steep). In this way, in the present embodiment, as shown in FIG. 4, the graph showing a temporal change in water level in the reservoir tank 10 is bent when the water level in the reservoir tank 10 reaches the inflection water level $L_2$, and the slope of the graph becomes steep.

Furthermore, when the water level in the reservoir tank 10 is lowered, and the water level in the reservoir tank 10 is lowered up to a dead water level $L_3$ at time $t_4$ in FIG. 4, the discharge valve 12 is seated on the discharge port 10*a* and is closed, whereby the flush water stops being discharged from the reservoir tank 10. Hereby, the water stops being discharged from the jet spout port 2*b* and the rim spout port 2*d*. Thus, during a flush on the flush toilet main body 2, the discharge valve 12 is opened until the water level in the reservoir tank 10 is lowered from the predetermined full water level $L_1$ to the predetermined dead water level $L_3$. As shown in FIG. 4, the lowering speed of the water level in the reservoir tank 10 changes at the inflection water level $L_2$ between the full water level $L_1$ and the dead water level $L_3$, and the lowering speed of the water level between the inflection water level $L_2$ and the dead water level $L_3$ is faster than the lowering speed of the water level between the full water level $L_1$ and the inflection water level $L_2$. Thus, since the lowering speed of the water level in the reservoir tank 10 is relatively fast while the water level is lowered from the full water level $L_1$ to the dead water level $L_3$, the movement of the discharge valve 12 falling down with the lowering of the water level is stable, and the discharge valve 12 is exactly closed when a predetermined amount of flush water is discharged.

During a flush, a time period (times $t_1$ to $t_3$) required for lowering the water level in the reservoir tank 10 from the full water level $L_1$ to the inflection water level $L_2$ is longer than a time period (times $t_3$ to $t_4$) required for lowering the water level in the reservoir tank 10 from the inflection water level $L_2$ to the dead water level $L_3$. The reservoir tank 10 is configured so that the volume of the flush water stored in a side upper than the inflection water level $L_2$ is larger than the volume of the flush water stored in a side lower than the inflection water level $L_2$ (and a side upper than the dead water level $L_3$). Therefore, during a flush, an amount of the flush water discharged from the discharge port 10*a* while the water level in the reservoir tank 10 is lowered from the full water level $L_1$ to the inflection water level $L_2$ is larger than the amount of the flush water discharged from the discharge port 10*a* while the water level in the reservoir tank 10 is lowered from the inflection water level $L_2$ to the dead water level $L_3$.

Next, after the water level in the reservoir tank 10 is lowered up to the dead water level $L_3$, the controller 28 performs the energization to the electromagnetic valve for water supply control (not illustrated) of the water supply valve 19, whereby the water supply valve 19 is opened. Note that in the present embodiment, since a bistable latching solenoid is used as the electromagnetic valve for water supply control, once the pilot valve port (not illustrated) of the water supply valve 19 is opened, the valve open state is maintained even when the energization is stopped.

When the water supply valve 19 is opened, the flush water supplied from the water supply pipe 32 flows into the reservoir tank 10 through the water supply valve 19. Hereby, the water level of the flush water in the reservoir tank 10 rises. When the water level of the flush water in the reservoir tank 10 rises to the predetermined full water level $L_1$, the controller 28 performs the energization to the electromagnetic valve for water supply control (not illustrated) of the water supply valve 19 again, whereby the water supply valve 19 is closed. Hereby, the flush toilet apparatus 1 returns to the standby state and completes one toilet flush.

Note that the present invention can be also constituted so that when a float switch (not illustrated) detects that the water level in the reservoir tank 10 rises to the full water level $L_1$, the controller 28 transmits a control signal to the water supply valve 19 on the basis of the detection of the float switch.

In the above-described embodiment, after the discharge valve 12 is closed, the water supply valve 19 is opened, and the supply of the flush water to the reservoir tank 10 is started. In contrast, as the modified example, the present invention can be also constituted so that the flush water is supplied to the reservoir tank 10 along with the discharge of the flush water from the discharge port 10*a*. Furthermore, the present invention can be also constituted so that after the discharge valve 12 is closed, the flush water supplied from the waterworks C flows as refill water into the bowl 2*a*. For example, a part of the flush water that has flowed in through the water supply valve 19 may branch so that the branched flush water flows into the bowl 2*a*. In this case, an overflow pipe (not illustrated) allowing communication between the interior of the reservoir tank 10 and the bowl 2*a* by bypassing the discharge valve 12 is provided in the reservoir tank 10, so that the branched flush water flows into the overflow pipe.

According to the flush toilet apparatus 1 of the first embodiment of the present invention, since the lowering speed of the water level is set to be faster during a time period between the inflection water level $L_2$ and the dead water level $L_3$, the discharge valve 12 approaching the discharge port 10*a* closes the discharge port 10*a* rapidly, whereby the operation of the discharge valve 12 can be stabilized and the variation in flushing performance can be reduced. Since the lowering speed of the water level is set to be slower during a time period between the full water level $L_1$ and the inflection water level $L_2$, a sufficient amount of flush water can be discharged to the flush toilet main body 2 during this time period, whereby the necessary amount of the flush water can be secured.

According to the flush toilet apparatus 1 of the present embodiment, since the time period (times $t_1$ to $t_3$) required for lowering the water level in the reservoir tank 10 from the full water level $L_1$ to the inflection water level $L_2$ is longer than the time period (times $t_3$ to $t_4$) required for lowering the water level in the reservoir tank 10 from the inflection water level $L_2$ to the dead water level $L_3$, the sufficient amount of the flush water can be discharged to the flush toilet main body 2 during this time period (times $t_1$ to $t_3$), whereby the sufficient flushing performance can be secured.

Furthermore, according to the flush toilet apparatus 1 of the present embodiment, since the amount of the flush water discharged from the discharge port 10*a* while the water level in the reservoir tank 10 is lowered from the full water level $L_1$ to the inflection water level $L_2$ is larger than the amount of the flush water discharged from the discharge port 10*a* while the water level is lowered from the inflection water level $L_2$ to the dead water level $L_3$, the sufficient amount of the flush water can be discharged from the flush toilet main body 2 while increasing the lowering speed of the water level near the dead water level $L_3$, whereby the sufficient flushing performance can be secured.

According to the flush toilet apparatus 1 of the present embodiment, since the reservoir tank 10 is formed so that the horizontal cross-sectional area on the side upper than the inflection water level $L_2$ is larger than the horizontal cross-sectional area on the side lower than the inflection water level $L_2$, the lower speed of the water level can be increased on the side lower than the inflection water level $L_2$, whereby the lower speed of the water level can be changed with a simple configuration.

Furthermore, according to the flush toilet apparatus 1 of the present embodiment, since the discharge valve 12 is placed on one side with respect to the centerline CL in the horizontal direction of the reservoir tank 10, the cutout portion 10*b* can be created easily on the other side of the reservoir tank 10 on which the discharge valve 12 is not placed, which results in effective utilization of a space.

According to the flush toilet apparatus 1 of the present embodiment, since the discharge valve 12 is placed on a side having a larger volume with respect to the centerline CL in the horizontal direction of the reservoir tank 10, the discharge valve 12 and the discharge valve hydraulic drive part 14 configured to drive the discharge valve 12 can be easily accommodated in the reservoir tank 10.

Furthermore, according to the flush toilet apparatus 1 of the present embodiment, since the sloping surface 10*c* is provided in the bottom surface of the reservoir tank 10 so that a portion of the bottom surface in which the discharge valve 12 is provided is set low, the flush water in the reservoir tank 10 is collected in the portion in which the discharge valve 12 is provided, which makes it possible to effectively utilize the flush water in the reservoir tank 10.

Next, a flush water tank device according to a second embodiment of the present invention and a flush toilet apparatus provided with the same will be described with reference to FIG. 5. The flush water tank device of the present embodiment and the flush toilet apparatus provided with the same are different from those in the above-described first embodiment in the shape of the reservoir tank, and the control of the water supply valve 19 executed by the controller 28. Accordingly, hereinafter, only portions of the second embodiment of the present invention which are different from those of the first embodiment will be described, and the same configuration, functions, and effects as those in the first embodiment are not described.

Figure 5:
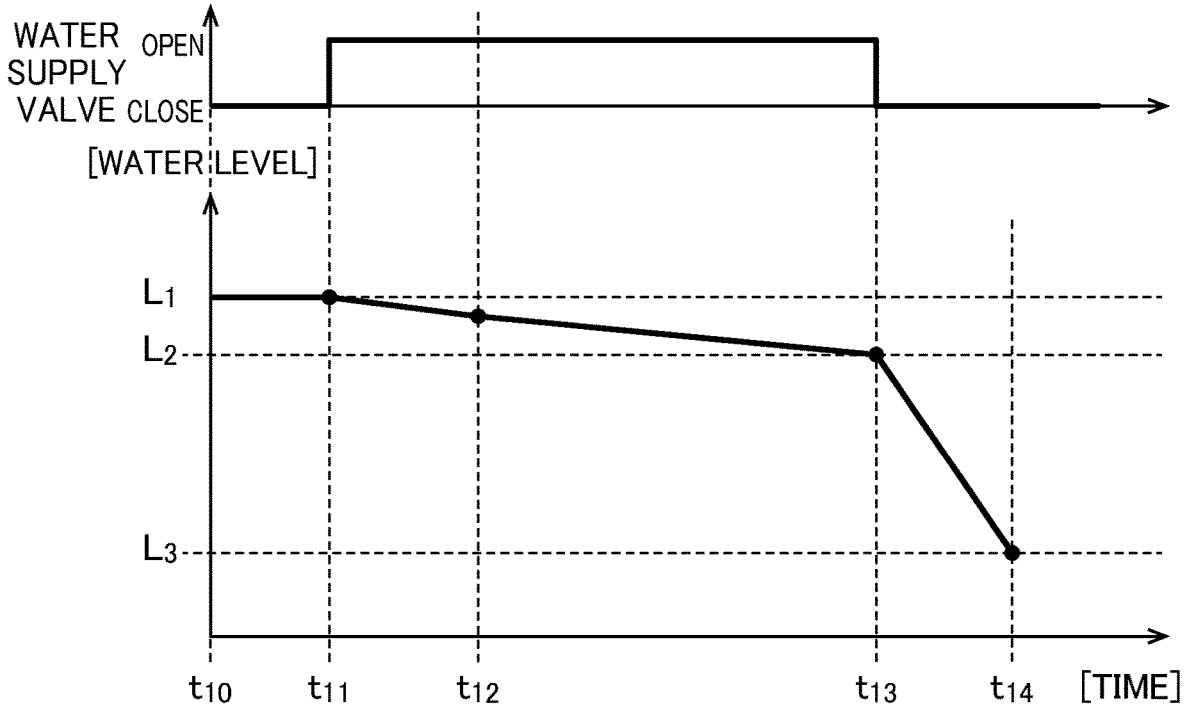
FIG. 5 is a graph showing a temporal change in water level in a reservoir tank during a toilet flush and a state of a water supply valve, in a flush toilet apparatus according to a second embodiment of the present invention.

FIG. 5 is a graph showing a temporal change in water level in a reservoir tank 10 during a toilet flush and a state of a water supply valve 19, in the flush toilet apparatus according to the second embodiment of the present invention. That is, in FIG. 5, an open-close state of the water supply valve 19 is shown in an upper stage, and a temporal change in water level in the reservoir tank is shown in a lower stage.

In the above-described first embodiment, the cutout portion 10*b* is provided in the lower portion of the reservoir tank 10, the horizontal cross-sectional area of the upper portion of the reservoir tank 10 is larger than the horizontal cross-sectional area of the lower portion of the reservoir tank 10. In contrast, the present embodiment is different from the first embodiment in which no cutout portion is provided in the reservoir tank, and the horizontal cross-sectional area of the reservoir tank is substantially constant (not illustrated) from the full water level to the dead water level.

First, in a standby state of a toilet flush at time $t_{10}$ in FIG. 5, a water level in the reservoir tank is a full water level $L_1$, and a water spout control valve 18 and the water supply valve 19 are closed. Next, when a user operates a lever handle 8 at time $t_{11}$ in FIG. 5 to execute the toilet flush, a signal instructing the toilet flush is transmitted to the controller 28 (FIG. 3). When receiving the instruction signal for the toilet flush, the controller 28 performs the energization to the electromagnetic valve for water spout control of the water spout control valve 18 to open the water spout control valve 18.

When the water spout control valve 18 is opened, tap water (flush water) supplied from the water supply pipe 32 flows into a cylinder 14 of a discharge valve hydraulic drive part 14, whereby a piston 14*b* is pushed up. Hereby, a rod 15 connected to the piston 14*b* and the discharge valve 12 are also lifted up, whereby a discharge port 10*a* is opened. That is, when the flush operation is performed at time $t_{11}$ in FIG. 5, the discharge valve 12 starts to be opened, and the discharge valve 12 is fully opened at time $t_{12}$.

Hereby, the flush water stored in the reservoir tank is discharged from a jet spout port 2*b* (FIG. 2) and a rim spout port 2*d* in a bowl 2, whereby the bowl 2*a* is washed.

As shown in the upper stage in FIG. 5, at time $t_{11}$, the controller 28 performs the energization to an electromagnetic valve for water supply control of the water supply valve 19 to open the water supply valve 19. Therefore, at and after time $t_{11}$, the water spout control valve 18 and the water supply valve 19 are opened at the same time, and the water discharge from the reservoir tank is performed along with the water supply to the reservoir tank via the water supply valve 19.

On the other hand, when the piston 14*b* is pushed up in the discharge valve hydraulic drive part 14 and accordingly the rod 15 and the discharge valve 12 are lifted up to a predetermined position, the clutch mechanism 22 separates the lower rod 15*b* and the discharge valve 12 from the upper rod 15*a*. The lower rod 15*b* and the discharge valve 12 separated from the upper rod fall down toward the discharge port 10*a* by gravity with lowering of the water level in the reservoir tank 10 while receiving buoyancy from the flush water in the reservoir tank 10. After the lower rod 15*b* and the discharge valve 12 are separated from the upper rod, the controller 28 (FIG. 3) performs the energization to the electromagnetic valve for water spout control of the water spout control valve 18 to close the water spout control valve 18.

On the other hand, as shown in FIG. 5, at time $t_{11}$, the discharge 12 is opened, and the water supply to the reservoir tank via the water supply valve 19 is started. Here, since the flow rate (L/min) of the flush water discharged from the reservoir tank via the discharge port 10*a* is larger than the flow rate (L/min) of the flush water flowing into the reservoir tank via the water supply valve 19, the water level in the reservoir tank is lowered.

Next, at time $t_{13}$ when the water level in the reservoir tank is lowered up to a predetermined inflection water level $L_2$, the controller 28 (FIG. 3) performs the energization to the electromagnetic valve for water supply control (not illustrated) of the water supply valve 19 again, whereby the water supply valve 19 is closed. Hereby, the flush water supplied from the waterworks C stops flowing into the reservoir tank. Therefore, when the water level is lowered up to the inflection water level $L_2$, the flush water stops flowing into the reservoir tank, and the lowering speed of the water level in the reservoir tank increases. That is, when the water level in the reservoir tank is between the full water level $L_1$ and an inflection water level $L_2$, the lowering speed of the water level is slow, and when the water level in the reservoir tank is equal to or lower than the inflection water level $L_2$, the lowering speed of the water level increases.

Hereby, after the discharge valve 12 is opened at time $t_{11}$ in FIG. 5, the lowering speed of the water level in the reservoir tank is slow (the slope of the graph in FIG. 5 is gentle) while the water level is higher than the inflection water level $L_2$, and when the water level in the reservoir tank is lowered up to the inflection water level $L_2$ at time $t_{12}$, the lowering speed of the water level increases (the slope of the graph in FIG. 5 becomes steep). That is, in the present embodiment, as shown in FIG. 5, the graph showing a temporal change in water level in the reservoir tank is bent when the water level in the reservoir tank reaches the inflection water level $L_2$, and the slope of the graph becomes steep.

Note that in the present embodiment, when the float switch (not illustrated) detects the water level in the reservoir tank and detects that the detected water level is lowered up to the predetermined inflection water level $L_2$, the controller 28 (FIG. 3) closes the water supply valve 19. In addition, as the modified example, the present invention can be also constituted so that the water supply valve 19 is closed at time $t_{13}$ after an elapse of a predetermined time period after the water supply valve 19 is opened at time $t_{11}$ in FIG. 5. In the present embodiment, when the water level in the reservoir tank is lowered up to the inflection water level $L_2$, the water supply valve 19 is closed to stop the supply of the flush water, but, as the modified example, the present invention can be also constituted so that the flow rate (L/min) to be supplied is reduced without completely stopping the supply of the flush water via the water supply valve 19.

Furthermore, when the water level in the reservoir tank is lowered, and the water level in the reservoir tank is lowered up to the dead water level $L_3$ at time $t_{14}$ in FIG. 5, the discharge valve 12 is seated on the discharge port 10*a* and is closed, whereby the flush water stops being discharged from the reservoir tank. Hereby, the water stops being discharged from the jet spout port 2*b* and the rim spout port 2*d*. Thus, during a flush on the flush toilet main body 2, the discharge valve 12 is opened until the water level in the reservoir tank 10 is lowered from the predetermined full water level $L_1$ to the predetermined dead water level $L_3$. As shown in FIG. 5, the lowering speed of the water level in the reservoir tank changes at the inflection water level $L_2$ between the full water level $L_1$ and the dead water level $L_3$, and the lowering speed of the water level between the inflection water level $L_2$ and the dead water level $L_3$ is faster than the lowering speed of the water level between the full water level $L_1$ and the inflection water level $L_2$. Thus, since the lowering speed of the water level in the reservoir tank is relatively fast while the water level is lowered from the full water level $L_1$ to the dead water level $L_3$, the movement of the discharge valve 12 falling down with the lowering of the water level is stable, and the discharge valve 12 is exactly closed when a predetermined amount of flush water is discharged.

Furthermore, also in the present embodiment, during a flush, a time period (times $t_{11}$ to $t_{13}$) required for lowering the water level in the reservoir tank 10 from the full water level $L_1$ to the inflection water level $L_2$ is longer than a time period (times $t_{13}$ to $t_{14}$) required for lowering the water level in the reservoir tank from the inflection water level $L_2$ to the dead water level $L_3$. Furthermore, during a flush, an amount of the flush water discharged from the discharge port 10*a* while the water level in the reservoir tank is lowered from the full water level $L_1$ to the inflection water level $L_2$ is larger than the amount of the flush water discharged from the discharge port 10*a* while the water level in the reservoir tank is lowered from the inflection water level $L_2$ to the dead water level $L_3$.

Next, after the water level in the reservoir tank is lowered up to the dead water level $L_3$, the controller 28 opens the water supply valve 19 to cause the flush water supplied from the water supply pipe 32 to flow into the reservoir tank. When the water level of the flush water in the reservoir tank rises to the predetermined full water level $L_1$, the controller 28 closes the water supply valve 19. Hereby, the flush toilet apparatus 1 returns to the standby state and completes one toilet flush.

According to the flush toilet apparatus of the second embodiment of the present invention, while the water level is lowered from the full water level $L_1$ to the inflection water level $L_2$, the water is discharged while being supplied to the reservoir tank, which enables the lowering speed of the water level to be reduced. Therefore, even when a normal reservoir tank in which the horizontal cross-sectional area is substantially constant is used, the lowering speed of the water level between the inflection water level $L_2$ and the dead water level $L_3$ can be faster than the lowering speed of the water level between the full water level $L_1$ and the inflection water level $L_2$.

The embodiments of the present invention have been described above, but various changes may be added to the above-described embodiments. In particular, in the above-described embodiments, the flush water is supplied from the reservoir tank to the rim spout port and the jet spout port, but the present invention can be constituted so that the flush water is directly supplied from the waterworks to any one of the rim spout port and the jet spout port. Furthermore, in the above-described embodiments, the rim spout port and the jet spout port are provided as the spout ports, but the present invention can be applied to a flush toilet having an arbitrary spout port. The present invention can be constituted by optionally combining the above-described optional structural elements included in each embodiment of the present invention with configurations of the other embodiments.

REFERENCE SIGNS LIST

1 Flush toilet apparatus
2 Flush toilet main body (flush toilet)
2*a* Bowl
2*b* Jet spout port
2*c* Rim
2*d* Rim spout port
4 Flush water tank device
8 Lever handle
10 Reservoir tank (flush water tank main body)
10*a* Discharge port
10*b* Cutout portion
10*c* Sloping surface
12 Discharge valve
14 Discharge valve hydraulic drive part
14*a* Cylinder
14*b* Piston
14*c* Spring
15 Rod
15*a* Upper rod
15*b* Lower rod
18 Water spout control valve
18*a* Control valve main body
18*b* Main valve body
19 Water supply valve
22 Clutch mechanism
24 Outflow pipe
28 Controller
32 Water supply pipe
32*a* Stop cock
32*b* Fixed flow valve

What is claimed is:

1. A flush water tank device that stores flush water for flushing a flush toilet, the flush water tank device comprising:

a flush water tank main body that includes a discharge port and is configured to store the flush water;

a water supply valve that causes the flush water supplied from a water supply source to flow into the flush water tank main body; and a discharge valve that is provided in the flush water tank main body and is configured to open and close the discharge port to switch between discharging and stopping of the flush water stored in the flush water tank main body to the flush toilet, wherein during a flush of the flush toilet, the discharge valve is opened until a water level in the flush water tank main body is lowered from a predetermined full water level to a predetermined dead water level, a lowering speed of the water level in the flush water tank main body changes at a predetermined inflection water level between the full water level and the dead water level, wherein the flush water tank main body is formed so that a horizontal cross-sectional area on a side upper than the inflection water level is larger than a horizontal cross-sectional area on a side lower than the inflection water level, thereby the lowering speed of the water level between the inflection water level and the dead water level is faster than the lowering speed of the water level between the full water level and the inflection water level, and wherein the flush water tank main body is configured so that a volume on one side with respect to a centerline in the horizontal direction of the flush water tank main body is larger than a volume on the other side, and the discharge valve is placed on the side having a larger volume with respect to the centerline in the horizontal direction of the flush water tank main body.

2. The flush water tank device according to claim 1, wherein during a flush of the flush toilet, a time period required for lowering the water level in the flush water tank main body from the full water level to the inflection water level is longer than a time period required for lowering the water level in the flush water tank main body from the inflection water level to the dead water level.

3. The flush water tank device according to claim 1, wherein during a flush of the flush toilet, an amount of the flush water discharged from the discharge port while the water level in the flush water tank main body is lowered from the full water level to the inflection water level is larger than the amount of the flush water discharged from the discharge port while the water level in the flush water tank main body is lowered from the inflection water level to the dead water level.

4. The flush water tank device according to claim 1, wherein the discharge valve is placed on one side with respect to a centerline in a horizontal direction of the flush water tank main body.

5. The flush water tank device according to claim 1, wherein at least a part of a bottom surface of the flush water tank main body is sloped so that a portion of the bottom surface in which the discharge valve is provided is set low.

6. A flush water tank device that stores flush water for flushing a flush toilet, the flush water tank device comprising:

a flush water tank main body that includes a discharge port and is configured to store the flush water;

a water supply valve that causes the flush water supplied from a water supply source to flow into the flush water tank main body; and a discharge valve that is provided in the flush water tank main body and is configured to open and close the discharge port to switch between discharging and stopping of the flush water stored in the flush water tank main body to the flush toilet, wherein during a flush of the flush toilet, the discharge valve is opened until a water level in the flush water tank main body is lowered from a predetermined full water level to a predetermined dead water level, a lowering speed of the water level in the flush water tank main body changes at a predetermined inflection water level between the full water level and the dead water level, wherein the flush water tank main body is formed so that a horizontal cross-sectional area on a side upper than the inflection water level is larger than a horizontal cross-sectional area on a side lower than the inflection water level, thereby the lowering speed of the water level between the inflection water level and the dead water level is faster than the lowering speed of the water level between the full water level and the inflection water level, and wherein the water supply valve is configured to cause the flush water supplied from the water supply source to flow into the flush water tank main body during a time period from when the discharge valve is opened until the water level in the flush water tank main body is lowered from the full water level to the inflection water level, and to stop the flush water flowing in from the water supply source or reduce a flow rate of the flush water flowing in the flush water tank main body when the water level in the flush water tank main body becomes lower than the inflection water level.

7. A flush toilet apparatus, comprising:

a flush toilet that includes a bowl, and a rim spout port and a jet spout port configured to discharge flush water for washing the bowl; and the flush water tank device according to claim 1 configured to store the flush water to be discharged from the jet spout port.

* * * * *